US011346500B2

(12) United States Patent
Sawai

(10) Patent No.: US 11,346,500 B2
(45) Date of Patent: May 31, 2022

(54) PRESSURE VESSEL

(71) Applicant: Toyota Jidosha Kabushiki Kaisha, Toyota (JP)

(72) Inventor: Osamu Sawai, Okazaki (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 178 days.

(21) Appl. No.: 16/560,056

(22) Filed: Sep. 4, 2019

(65) Prior Publication Data

US 2020/0116305 A1 Apr. 16, 2020

(30) Foreign Application Priority Data

Oct. 11, 2018 (JP) ..... JP2018-192439

(51) Int. Cl.
*F17C 1/06* (2006.01)
*F17C 1/08* (2006.01)
*F17C 13/06* (2006.01)

(52) U.S. Cl.
CPC ..... *F17C 1/08* (2013.01); *F17C 13/06* (2013.01); *F17C 2201/0109* (2013.01); *F17C 2203/012* (2013.01); *F17C 2203/0604* (2013.01); *F17C 2203/0619* (2013.01); *F17C 2203/0663* (2013.01); *F17C 2221/012* (2013.01); *F17C 2270/0168* (2013.01); *F17C 2270/0184* (2013.01)

(58) Field of Classification Search
CPC ..... F17C 2203/0604; F17C 2203/068; F17C 2203/066; F17C 2203/0624; F17C 2203/0631; F17C 2203/012; F17C 2203/0619; F17C 2203/0663; F17C 1/06; F17C 1/04
See application file for complete search history.

(56) References Cited

U.S. PATENT DOCUMENTS 9,109,750 B2 8/2015 Okawachi et al.
2014/0008373 A1* 1/2014 Sharp ..... F17C 1/16 220/586

(Continued)

FOREIGN PATENT DOCUMENTS

CN 104455410 A 3/2015
JP H10274392 A 10/1998

(Continued)

OTHER PUBLICATIONS

Table of Coefficients of Linear Thermal Expansion from The Engineering Tool Box, www.EngineeringToolBox.com, 10 pages.*

*Primary Examiner* — Stephen J Castellano
(74) *Attorney, Agent, or Firm* — Dinsmore & Shohl LLP

(57) ABSTRACT

A pressure vessel includes a liner and a reinforcing layer. The liner includes a body portion having a cylindrical shape. The liner is configured such that a gas is filled in the liner. The reinforcing layer is made of a material having a linear expansion coefficient lower than a linear expansion coefficient of a material of the liner. The reinforcing layer is formed in contact with an outer surface of the body portion. The reinforcing layer is configured to cover the liner from outside the liner. A thickness of the body portion is set to such a value that the outer surface of the body portion is not separated from the reinforcing layer when the gas that has been filled in the liner is discharged out of the liner.

6 Claims, 2 Drawing Sheets

(56) References Cited

U.S. PATENT DOCUMENTS

| | | | | |
|---|---|---|---|---|
| 2015/0014332 | A1 | 1/2015 | Nishibu | |
| 2018/0195669 | A1 | 7/2018 | Sawai | |
| 2018/0238491 | A1* | 8/2018 | Imai | B29C 69/007 |

FOREIGN PATENT DOCUMENTS

| | | | |
|---|---|---|---|
| JP | 2008-164112 | A | 7/2008 |
| JP | 2008-164134 | A | 7/2008 |
| JP | 2014-020440 | A | 2/2014 |
| JP | 2015-017641 | A | 1/2015 |
| JP | 2016-080058 | A | 5/2016 |
| JP | 2017-020558 | A | 1/2017 |
| JP | 2018-112201 | A | 7/2018 |

* cited by examiner

PRESSURE VESSEL

CROSS-REFERENCE TO RELATED APPLICATIONS

This application claims priority to Japanese Patent Application No. 2018-192439 filed on Oct. 11, 2018, which is incorporated herein by reference in its entirety including the specification, drawings and abstract.

BACKGROUND

1. Technical Field

The disclosure relates to a pressure vessel.

2. Description of Related Art

Japanese Unexamined Patent Application Publication No. 2015-017641 (JP 2015-017641 A) discloses a pressure vessel (high-pressure vessel) configured to store hydrogen. The pressure vessel described in JP 2015-017641 A includes a liner and a reinforcing layer. The liner includes a body portion having a cylindrical shape. The reinforcing layer is made of a fiber-reinforced resin. The reinforcing layer is formed around an outer surface of the liner.

SUMMARY

In a state where the temperature and pressure inside the pressure vessel become both low, the liner and the reinforcing layer may be separated from each other due to a difference between the amount of contraction of the liner and the amount of contraction of the reinforcing layer. When a gas (hydrogen) is filled (supplied) into the pressure vessel with the liner and the reinforcing layer separated from each other, localized elongation of the liner may occur.

The disclosure provides a pressure vessel configured to restrain a liner from being locally elongated when a gas s filled into the liner in a state where the temperature and pressure inside the pressure vessel become both low.

An aspect of the disclosure relates to a pressure vessel including a liner and a reinforcing layer. The liner includes a body portion having a cylindrical shape. The liner is configured such that a gas is filled in the liner. The reinforcing layer is made of a material having a linear expansion coefficient lower than a linear expansion coefficient of a material of the liner. The reinforcing layer is formed in contact with an outer surface of the body portion. The reinforcing layer is configured to cover the liner from outside the liner. A thickness of the body portion is set to such a value that the outer surface of the body portion is not separated from the reinforcing layer when the gas that has been filled in the liner is discharged out of the liner.

The pressure vessel according to the aspect of the disclosure produces an advantageous effect of retraining the liner from being locally elongated when the gas is filled into the liner in a state where the temperature and pressure inside the pressure vessel become both low.

In the pressure vessel according to the aspect, the thickness of the body portion may be set to such a value that the outer surface of the body portion presses an inner surface of the reinforcing layer when the gas that has been filled in the liner is discharged out of the liner.

In the pressure vessel according to the aspect, the reinforcing layer may be made of a fiber-reinforced resin. Further, the thickness t of the body portion may satisfy an equation below.

$$t < \frac{P \cdot r}{E \cdot \alpha \cdot \Delta T}$$

where t (mm) represents the thickness of the body portion, 2r (mm) represents an inner diameter of the body portion, E (MPa) represents an clastic modulus of the material of the liner, α (1/K) represents the linear expansion coefficient of the material of the liner. ΔT (° C.) represents a temperature difference between a temperature of the liner at a time when the reinforcing layer is formed around the liner and an assumed lowest temperature of the liner, and P (MPa) represents a lowest pressure inside the liner.

In the pressure vessel according to the aspect, the thickness t of the body portion may satisfy an equation below, $$t < \frac{P \cdot r}{E \cdot (\alpha 1 - \alpha 2) \cdot \Delta T}$$

where t (mm) represents the thickness of the body portion, 2r (mm) represents an inner diameter of the body portion, C (MPa) represents an elastic modulus of the material of the liner, α1 (1/K) represents the linear expansion coefficient of the material of the liner, α2 (1/K) represents the linear expansion coefficient of the material of the reinforcing layer, ΔT (° C.) represents a temperature difference between a temperature of the liner at a time when the reinforcing layer is formed around the liner and an assumed lowest temperature of the liner, and P (MPa) represents a lowest pressure inside the liner.

In the pressure vessel according to the aspect, the gas to be filled in the liner may be hydrogen, the temperature of the liner at the time when the reinforcing layer is formed around the liner may be within a range from 20° C. to 30° C., and the assumed lowest temperature of the liner may be within a range from −70° C. to −60° C.

BRIEF DESCRIPTION OF THE DRAWINGS

Features, advantages, and technical and industrial significance of exemplary embodiments of the disclosure will be described below with reference to the accompanying drawings, in which like signs denote like elements, and wherein.

DETAILED DESCRIPTION OF EMBODIMENTS

Configuration of Pressure Vessel

Hereinafter, a pressure vessel according to an example embodiment of the disclosure will be described with reference to FIG. 1 and FIG. 2.

Figure 1:
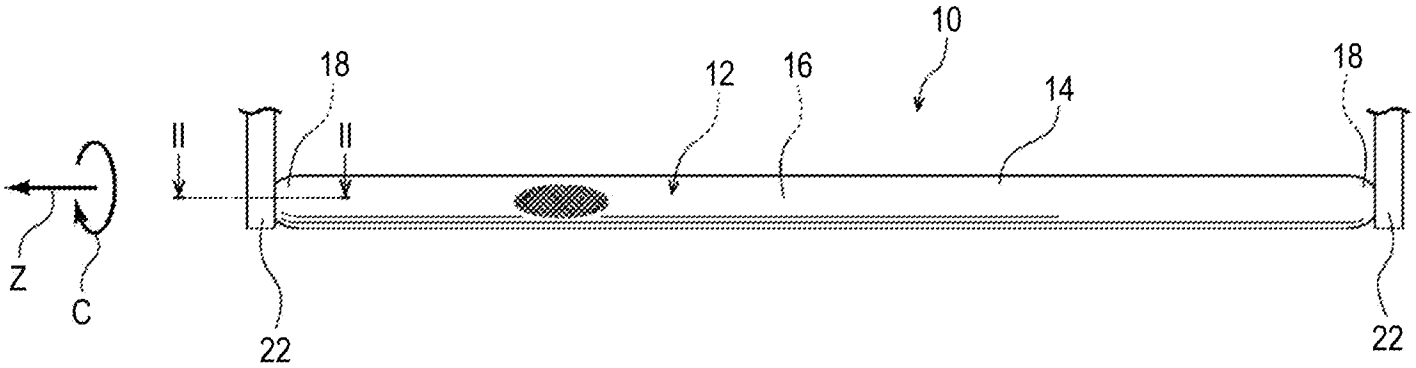
FIG. 1 is a side view of a pressure vessel according to an embodiment.

FIG. 1 illustrates a pressure vessel 10 according to the present embodiment. The pressure vessel 10 is a part of a tank module mounted in, for example, a fuel cell vehicle. The tank module includes a plurality of pressure vessels 10 connected to each other.

Figure 2:
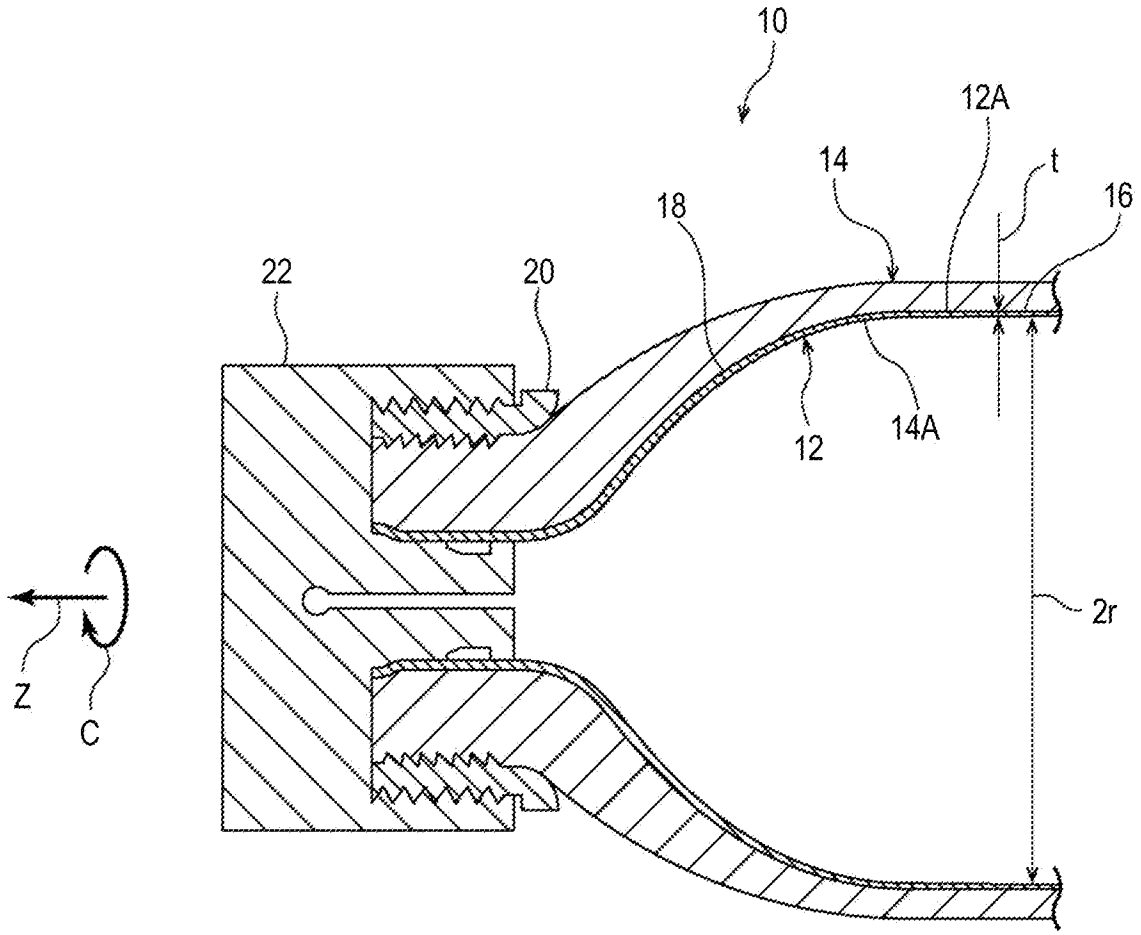
FIG. 2 is an enlarged sectional view illustrating a section of the pressure vessel taken along line II-II in FIG. 1.

As illustrated in FIG. 1 and FIG. 2, the pressure vessel 10 includes a liner 12 and a reinforcing layer 14. The liner 12 is configured such that gaseous hydrogen is filled in the liner 12. The reinforcing layer 14 is configured to cover the liner 12 from outside the liner 12.

As illustrated in FIG. 2, the liner 12 is made of a resin material, such as nylon. The liner 12 has a generally cylindrical shape that are open at both ends. Hereafter, a cylindrical portion of tire liner 12, which has a constant inner diameter and a constant outer diameter, will be referred to as a body portion 16. Further, both side portions of the liner 12 in its longitudinal direction (the direction of an arrow Z) will be referred to as shoulder portions 18. Each shoulder portion 18 has a diameter that gradually decreases in a direction away from the body portion 16.

The reinforcing layer 14 is made of a fiber-reinforced resin that is a material having a linear expansion coefficient lower than a linear expansion coefficient of a material of the liner 12. In the present embodiment, a carbon fiber-reinforced resin (referred also to as "carbon fiber-reinforced plastic (CFRP)") is used as the fiber-reinforced resin. The carbon fiber-reinforced resin is wound around the entire outer surface of the liner 12, whereby the reinforcing layer 14 that covers the liner 12 from outside the liner 12 is formed.

Caps 22 are respectively engaged, via seal members 20, with two longitudinally-end portions of the liner 12 covered with the reinforcing layer 14. With this configuration, one of the open ends of the liner 12 is closed by one of the caps 22, and the other one of the open ends of the liner 12 is connected to another pressure vessel 10 via the other one of the caps 22. Note that, FIG. 2 illustrates one of the end portions of the liner 12 covered with the reinforcing layer 14; and the end portion of the liner 12 illustrated in FIG. 2 is closed by the cap 22.

Regarding State where Temperature and Pressure Inside Liner of Pressure Vessel Become Both Low In a state where the fuel cell vehicle equipped with the pressure vessel 10 described above (equipped with the tank module) is traveling under a low-temperature environment and a fuel cell is operated at maximum power output, the hydrogen that has been filled in the liner 12 of the pressure vessel 10 is rapidly consumed (discharged). Note that, an example of the "state where the fuel cell vehicle is traveling under a low-temperature environment and the fuel cell is operated at maximum power output" is a "state where the fuel cell vehicle is traveling at a maximum speed or traveling on an uphill slope under an environment of −40° C."

When the hydrogen that has been filled in the liner 12 of the pressure vessel 10 is rapidly consumed in the above-described environment and state, the temperature and pressure inside the liner 12 become both low. In this case, the liner 12 and the reinforcing layer 14 may be separated from each other (a gap may be formed between the liner 12 and the reinforcing lava 14) due to a difference between the amount of contraction of the liner 12 and the amount of contraction of the reinforcing layer 14. When hydrogen is filled into the pressure vessel 10 (the tank module) with the liner 12 and the reinforcing layer 14 separated from each other, first, the body portion 16 of the liner 12 and the reinforcing layer 14 come into contact with each other again, and then the shoulder portions 18 of the liner 12 and the reinforcing layer 14 come into contact with each other again. In the state where the body portion 16 of the liner 12 and the reinforcing layer 14 have come into contact with each other again due to filling of the hydrogen into the pressure vessel 10, elongation deformation of the body portion 16 of the liner 12 in the longitudinal direction of the liner 12 is restrained by a force of friction between the body portion 16 of the liner 12 and the reinforcing layer 14. When hydrogen is further filled into the pressure vessel 10 in the state where the body portion 16 of the liner 12 and the reinforcing layer 14 have come into contact with each other again, localized elongation occurs at the boundary between the body portion 16 and each shoulder portion 18.

In view of this, in the present embodiment, a thickness t of the body portion 16 of the liner 12 is set to such a thickness that an outer surface 12A of the body portion 16 of the liner 12 is not separated from an inner peripheral surface (inner surface) 14A of the reinforcing layer 14 in a state where the temperature and pressure inside the liner 12 become both low. This is because, when the outer surface 12A of the body portion 16 of the liner 12 is not separated from the inner peripheral surface 14A of the reinforcing layer 14 in a state where the temperature and pressure inside the liner 12 become both low, it is possible to prevent the occurrence of the above-described phenomenon in which localized elongation occurs at the boundary between the body portion 16 and each shoulder portion 18 due to filling of hydrogen into the pressure vessel 10.

Regarding Thickness of Body Portion of Liner

Hereafter, t (mm) represents a thickness of the body portion 16 of the liner 12, 2r (mm) represents an inner diameter of the body portion 16, and E (MPa) represents an elastic modulus of a material of the liner 12. Further, $\alpha$ (1/K) represents a linear expansion coefficient of the material of the liner 12, $\Delta T$ (° C.) represents a temperature difference between a temperature of the liner 12 at the time when the reinforcing layer 14 is formed around the liner 12 and an assumed lowest temperature of the liner 12, and P (MPa) represents a lowest pressure inside the liner 12.

Note that the thickness t (mm) of the body portion 16 of the liner 12 and the inner diameter 2r (mm) of the body portion 16 are dimensions (dimensions based on drawing values) at a temperature at the time when the reinforcing layer 14 is formed around the liner 12. The elastic modulus E (MPa) of the material of the liner 12 is a value at an assumed lowest temperature of the liner 12. Furthermore, the linear expansion coefficient $\alpha$ (1/K) of the material of the liner 12 represents an average of values within a range from the value at the temperature at the time when the reinforcing layer 14 is formed around the liner 12 to the value at the assumed lowest temperature of the liner 12. The lowest pressure inside the liner 12 is, for example, a lowest system operating pressure (an almost empty gas pressure) in a fuel cell system of the fuel cell vehicle equipped with the pressure vessel 10.

When the above conditions are taken into consideration, a circumferential stress (a stress in the direction of an arrow C in FIG. 2) generated in the body portion 16 due to the pressure P inside the liner 12 is expressed by Equation (1) below.

$$(P \cdot r)/t \qquad \text{Equation (1)}$$

Further, a circumferential stress generated in the body portion 16 due to thermal contraction of the liner 12 is expressed by Equation (2) below.

$$E \cdot \alpha \cdot \Delta T \qquad \text{Equation (2)}$$

The amount of thermal contraction due to a change in the temperature of a fiber-reinforced resin, such as a carbon fiber-reinforced resin, can be almost disregarded. Therefore, the amount of thermal contraction due to a change in the temperature of the reinforcing layer 14 is set to zero.

Further, in order to prevent the outer surface 12A of the body portion 16 of the liner 12 from being separated from the inner peripheral surface 14A of the reinforcing layer 14, the thickness t of the body portion 16 needs to be set to such a value that the value obtained by Equation (1) is greater than the value obtained by Equation (2). That is, the thickness t of the body portion 16 needs to be set such that Equation (3) below is satisfied.

$$t < \frac{P \cdot r}{E \cdot \alpha \cdot \Delta T} \quad \text{Equation (3)}$$

Next, an example of the thickness t of the body portion 16 of the liner 12 will be described below.

In this case, the inner diameter of the body portion 16 is 82 (mm), and the elastic modulus of the material of the liner 12 is 2.5 (GPa). Further, the linear expansion coefficient of the material of the liner 12 is $13\times10^{-5}$ (1/K), the temperature of the liner 12 at the time when the reinforcing layer 14 is formed around the liner 12 is 23° C., the assumed lowest temperature of the liner 12 is −70° C., and the lowest pressure inside the liner 12 is 0.7 (MPa). Note that, these values are set values of the pressure vessel 10 produced as a prototype, values based on manufacturing conditions, and values obtained based on experiments of a fuel cell vehicle.

Based on the foregoing values and Equation (3), when the thickness t of the body portion 16 of the liner 12 is set to be less than about 0.9 mm, the outer surface 12A of the body portion 16 of the liner 12 is not separated from the inner peripheral surface 14A of the reinforcing layer 14 in a state where the temperature and pressure inside the liner 12 become both low. As a result, when hydrogen is filled into the liner 12 in a state where the temperature and pressure inside the liner 12 become both low, it is possible to reduce the occurrence of localized elongation at the boundary between the body portion 16 and each shoulder portion 18 of the liner 12.

When the thickness t of the body portion 16 of the liner 12 is set to be less than 0.9 mm by a larger amount, the outer surface 12A of the body portion 16 presses the inner peripheral surface 14A of the reinforcing layer 14 in a state where the temperature and pressure inside the liner 12 become both low, based on the relationship between Equation (1) and Equation (2). In an example in which the thickness t of the body portion 16 is set to 0.65 mm, the outer surface 12A of the body portion 16 presses the inner peripheral surface 14A of the reinforcing layer 14 with a pressure of 0.2 MPa. In this way, a force of friction between the body portion 16 of the liner 12 and the reinforcing layer 14 can always be obtained. As a result, when hydrogen is filled into the liner 12 in a state where the temperature and pressure inside the liner 12 become both low, it is possible to more reliably reduce the occurrence of localized elongation at the boundary between the body portion 16 of the liner 12 and each shoulder portion 18 of the liner 12.

In some embodiments, when the thickness t of the body portion 16 of the liner 12 is set to be small, the liner 12 has a multilayer structure of "nylon—an adhesive layer—an ethylene-vinylalcohol-copolymer resin (EVOH)—an adhesive layer—nylon." In this way, it is possible to ensure hydrogen permeation resistance of the liner 12.

In the present embodiment, the thickness t of the body portion 16 of the liner 12 is derived on the assumption that the temperature of the liner 12 at the time when the reinforcing layer 14 is formed around the liner 12 is 23° C. and the assumed lowest temperature of the liner 12 is −70° C. However, the temperature of the liner 12 at the time when the reinforcing layer 14 is formed around the liner 12 and the assumed lowest temperature of the liner 12 are not limited to the above-described temperatures. These temperatures may be set as appropriate in consideration of variations in the ambient temperature at the time of manufacturing and the environment under which the fuel cell vehicle is used. For example, when the ambient temperature at the time of manufacturing is within a range from 20° C. to 30° C., a value within this range may be adopted as the "temperature of the liner 12 at the time when the reinforcing layer 14 is formed around the liner 12." Further, when the lowest temperature under the environment where the fuel cell vehicle is used is within a range from −40° C. to −30° C., a value obtained in consideration of the values in this range and the experimental values may be adopted as the "assumed lowest temperature of the liner 12." Note that, in a ease where the lowest temperature under the environment where the fuel cell vehicle is used is within the range from −40° C. to −30° C. when the experimental values are taken into consideration, the "assumed lowest temperature of the liner 12" is a value within a range from −70° C. to −60° C.

In the example described in the present embodiment, the thickness t of the body portion 16 of the liner 12 is derived in disregard of the amount of thermal contraction due to a change in the temperature of the carbon fiber-reinforced resin of the reinforcing layer 14. However, the manner of considering the thickness t is not limited to this. When the amount of thermal contraction due to a change in the temperature of the material of the reinforcing layer 14 cannot be disregarded, the thickness t of the body portion 16 of the liner 12 may be derived according to Equation (4) below, where $\alpha 2$ (1/K) represents a linear expansion coefficient of the material of the reinforcing layer 14 and is $\alpha 1$ (1/K) represents a linear expansion coefficient of the material of the liner 12.

$$t < \frac{P \cdot r}{E \cdot (\alpha 1 - \alpha 2) \cdot \Delta T} \quad \text{Equation (4)}$$

Further, the material of the liner 12 and the material of the reinforcing layer 14 may be set as appropriate in consideration of the kind and pressure of a gas to be filled into the pressure vessel 10.

While one example embodiment of the disclosure has been described above, the disclosure is not limited to the foregoing embodiment, and various changes and modifications may be made to the foregoing embodiment within the technical scope of the appended claims.

What is claimed is:

1. A pressure vessel comprising:

a liner including a body portion having a cylindrical shape, the liner being configured such that a gas is filled in the liner; and a reinforcing layer made of a material having a linear expansion coefficient lower than a linear expansion coefficient of a material of the liner, the reinforcing layer being formed in contact with an outer surface of the body portion, and the reinforcing layer being configured to cover the liner from outside the liner, wherein:

the reinforcing layer is constructed of a fiber-reinforced resin, a thickness of the body portion is set to such a value that the outer surface of the body portion is not separated from the reinforcing layer and contacts the fiber-reinforced resin when the gas that has been filled in the liner is discharged out of the liner, and the liner has a multilayer structure of a first nylon layer, a first adhesive layer, an ethylene-vinylalcohol-copolymer resin layer, a second adhesive layer, and a second nylon layer.

2. The pressure vessel according to claim 1, wherein the thickness of the body portion is set to such a value that the outer surface of the body portion presses an inner surface of the reinforcing layer when the gas that has been filled in the liner is discharged out of the liner.

3. The pressure vessel according to claim 1, wherein:

the reinforcing layer is made of a fiber-reinforced resin; and the thickness of the body portion satisfies an equation below, $$t < \frac{P \cdot r}{E \cdot \alpha \cdot \Delta T}$$

where t (mm) represents the thickness of the body portion, 2r (mm) represents an inner diameter of the body portion, E (MPa) represents an elastic modulus of the material of the liner, α (1/K) represents the linear expansion coefficient of the material of the liner, ΔT (° C.) represents a temperature difference between a temperature of the liner at a time when the reinforcing layer is formed around the liner and an assumed lowest temperature of the liner, and P (MPa) represents a lowest pressure inside the liner.

4. The pressure vessel according to claim 3, wherein:

the gas to be filled in the liner is hydrogen, the temperature of the liner at the time when the reinforcing layer is formed around the liner is within a range from 20° C. to 30° C., and the assumed lowest temperature of the liner is within a range from 70° C. to 60° C.

5. The pressure vessel according to claim 1, wherein the thickness of the body portion satisfies an equation below, $$t < \frac{P \cdot r}{E \cdot (\alpha 1 - \alpha 2) \cdot \Delta T}$$

where t (mm) represents the thickness of the body portion, 2r (mm) represents an inner diameter of the body portion, E (MPa) represents an elastic modulus of the material of the liner, α1 (1/K) represents the linear expansion coefficient of the material of the liner, α2 (1/K) represents the linear expansion coefficient of the material of the reinforcing layer, ΔT (° C.) represents a temperature difference between a temperature of the liner at a time when the reinforcing layer is formed around the liner and an assumed lowest temperature of the liner, and P (MPa) represents a lowest pressure inside the liner.

6. The pressure vessel according to claim 5, wherein:

the gas to be filled in the liner is hydrogen, the temperature of the liner at the time when the reinforcing layer is formed around the liner is within a range from 20° C. to 30° C., and the assumed lowest temperature of the liner is within a range from −70° C. to −60° C.

* * * * *